US009869235B2

(12) United States Patent
Takayanagi

(10) Patent No.: US 9,869,235 B2
(45) Date of Patent: Jan. 16, 2018

(54) STRATIFIED SCAVENGING TWO-STROKE ENGINE

(71) Applicant: MAKITA CORPORATION, Aichi (JP)

(72) Inventor: Yoshiaki Takayanagi, Tachikawa (JP)

(73) Assignee: MAKITA CORPORATION, Aichi (JP)

( * ) Notice: Subject to any disclaimer, the term of this patent is extended or adjusted under 35 U.S.C. 154(b) by 158 days.

(21) Appl. No.: 14/850,452

(22) Filed: Sep. 10, 2015

(65) Prior Publication Data

US 2015/0377117 A1 Dec. 31, 2015

Related U.S. Application Data

(62) Division of application No. 14/100,465, filed on Dec. 9, 2013, now Pat. No. 9,206,736.

(30) Foreign Application Priority Data

Dec. 28, 2012 (JP) ..... 2012-286765

(51) Int. Cl.
*F02B 25/14* (2006.01)
*F02B 25/20* (2006.01)
(Continued)

(52) U.S. Cl.
CPC ..... *F02B 25/20* (2013.01); *F02B 25/14* (2013.01); *F02B 25/22* (2013.01); *F02B 33/04* (2013.01);
(Continued)

(58) Field of Classification Search
CPC ..... F02B 25/20; F02B 75/02; F02B 33/30; F02B 33/04; F02B 43/02; F02B 15/14;
(Continued)

(56) References Cited

U.S. PATENT DOCUMENTS 3,815,558 A 6/1974 Tenney
4,066,050 A 1/1978 Ford-Dunn
(Continued)

FOREIGN PATENT DOCUMENTS

AU 15166/97 9/1997
CN 1752423 3/2006
(Continued)

*Primary Examiner* — Marguerite McMahon
(74) *Attorney, Agent, or Firm* — Greenblum & Bernstein, P.L.C.

(57) ABSTRACT

A stratified scavenging two-stroke engine includes a first scavenging passage that extends from a first scavenging intake that opens to the inside of the crankcase to a scavenging port that opens to the inside of a cylinder, and a second scavenging passage that branches from the first scavenging passage and extends to a second scavenging intake that opens to the inside of the crankcase. An air passage is provided to supply air for pre-scavenging into the first scavenging passage at a position closer to the first scavenging intake than a position at which the second scavenging passage branches from the first scavenging passage. A first check valve inhibits a flow of air from the first scavenging passage during an upward stroke of the piston, and a second check valve inhibits a flow of air and a gaseous mixture from the first scavenging passage during a downward stroke of the piston.

4 Claims, 16 Drawing Sheets

(51) Int. Cl.

| | |
|---|---|
| ***F02F 3/24*** | (2006.01) |
| ***F02B 25/22*** | (2006.01) |
| ***F02B 43/02*** | (2006.01) |
| ***F02F 7/00*** | (2006.01) |
| ***F02B 33/04*** | (2006.01) |
| ***F02B 33/30*** | (2006.01) |
| *F02M 35/10* | (2006.01) |
| *F02B 75/02* | (2006.01) |

(52) U.S. Cl.
CPC ..... *F02B 33/30* (2013.01); *F02B 43/02* (2013.01); *F02B 75/02* (2013.01); *F02F 3/24* (2013.01); *F02F 7/0036* (2013.01); *F02B 2075/025* (2013.01); *F02B 2700/037* (2013.01); *F02M 35/1017* (2013.01); *F02M 35/10275* (2013.01)

(58) Field of Classification Search
CPC ..... F02B 25/22; F02B 2700/037; F02B 2075/025; F02M 35/10275; F02M 35/1017; F02F 7/0036
USPC ..... 123/73 PP, 73 C, 73 FA, 73 A, 65 W, 123/65 V, 295
See application file for complete search history.

(56) References Cited

U.S. PATENT DOCUMENTS

| | | | | |
|---|---|---|---|---|
| 4,075,985 | A | 2/1978 | Iwai | |
| 4,242,993 | A | 1/1981 | Onishi | |
| 4,577,597 | A | 3/1986 | Tomita | |
| 6,216,650 | B1 | 4/2001 | Noguchi | |
| 6,240,886 | B1 | 6/2001 | Noguchi | |
| 6,257,179 | B1 | 7/2001 | Uenoyama | |
| 6,289,856 | B1 | 9/2001 | Noguchi | |
| 6,298,811 | B1 | 10/2001 | Sawada et al. | |
| 6,415,750 | B2 | 7/2002 | Rosskamp | |
| 6,450,135 | B1 | 9/2002 | Araki | |
| 6,668,770 | B2 | 12/2003 | Carlsson et al. | |
| 6,712,029 | B1 | 3/2004 | Andersson et al. | |
| 6,817,323 | B2 | 11/2004 | Notaras et al. | |
| 7,025,021 | B1 | 4/2006 | Andersson et al. | |
| 7,082,910 | B2 | 8/2006 | Carlsson et al. | |
| 7,565,886 | B2 | 7/2009 | Carlsson et al. | |
| 7,574,984 | B2 | 8/2009 | Andersson et al. | |
| 8,181,611 | B2 | 5/2012 | Ishida | |
| 2001/0011531 | A1 | 8/2001 | Uenoyama et al. | |
| 2001/0020454 | A1 | 9/2001 | Kobayashi | |
| 2002/0139327 | A1 | 10/2002 | Uenoyama et al. | |
| 2003/0106508 | A1* | 6/2003 | Rosskamp | F02B 25/22 123/73 PP |
| 2003/0106509 | A1 | 6/2003 | Uenoyama et al. | |
| 2004/0025817 | A1 | 2/2004 | Uenoyama et al. | |
| 2005/0139179 | A1* | 6/2005 | Mavinahally | F01L 7/06 123/73 A |
| 2005/0155563 | A1 | 7/2005 | Yuasa et al. | |
| 2005/0284430 | A1 | 12/2005 | Yuasa et al. | |
| 2006/0005795 | A1* | 1/2006 | Yuasa | F02B 25/22 123/73 PP |
| 2007/0028868 | A1 | 2/2007 | Tsutsui | |
| 2007/0125325 | A1 | 6/2007 | Uenoyama et al. | |
| 2010/0012106 | A1 | 1/2010 | Ishida | |
| 2011/0162630 | A1 | 7/2011 | Takayanagi | |
| 2011/0308507 | A1* | 12/2011 | Yuasa | F02B 25/06 123/73 PP |

FOREIGN PATENT DOCUMENTS

| | | |
|---|---|---|
| EP | 0065315 | 11/1982 |
| EP | 0207446 | 1/1987 |
| EP | 0337768 | 10/1989 |
| EP | 0764774 | 3/1997 |
| EP | 2017446 | 1/2009 |
| FR | 2508103 | 12/1982 |
| GB | 2290349 | 12/1995 |
| JP | 55-4518 | 2/1980 |
| JP | 57188756 | 11/1982 |
| JP | 58-193015 | 12/1983 |
| JP | 3-54239 | 5/1991 |
| JP | 5033657 | 2/1993 |
| JP | 09-242546 | 9/1997 |
| JP | 10-121975 | 5/1998 |
| JP | 11-107761 | 4/1999 |
| JP | 3024072 | 3/2000 |
| JP | 2000186559 | 7/2000 |
| JP | 2001-254624 | 9/2001 |
| JP | 2001-263072 | 9/2001 |
| JP | 2001-317362 | 11/2001 |
| JP | 2003519747 | 6/2003 |
| JP | 2003519749 | 6/2003 |
| JP | 2006283629 | 10/2006 |
| JP | 2007-040272 | 2/2007 |
| JP | 2007-309128 | 11/2007 |
| WO | 98/57053 | 12/1998 |
| WO | 01/51783 | 7/2001 |
| WO | 2007/132716 | 11/2007 |
| WO | 2010/035684 | 4/2010 |

* cited by examiner

X

X

STRATIFIED SCAVENGING TWO-STROKE ENGINE

CROSS REFERENCE TO RELATED APPLICATION

This application is a divisional of application Ser. No. 14/100,465 filed Dec. 9, 2013, and which claims priority to Japanese Application No. 2012-286765, filed Dec. 28, 2012, the disclosures of which are expressly incorporated herein by reference in their entireties.

BACKGROUND OF THE INVENTION

1. Field of the Invention

The present invention relates to a stratified scavenging two-stroke engine, in more specifically, relates to a stratified scavenging two-stroke engine provided with an air passage for supplying air for pre-scavenging into a scavenging passage and a check valve for controlling open and close of the air passage to the scavenging passage.

2. Description of Related Art

In a stratified two-stroke engine, during an upward stroke of a piston, a gaseous mixture is supplied from an intake passage to the inside of a crankcase by a negative pressure generated inside of the crankcase, and air is supplied from an air passage into a scavenging passage. Furthermore, during a downward stroke of the piston, prior to supply of the gaseous mixture inside of the crankcase, the air, that has been supplied into the scavenging passage during the upward stroke of the piston, is supplied to the inside of the cylinder as air for pre-scavenging. Consequently, since a layer of air is present between a combustion gas (exhaust gas) produced by combustion and a gaseous mixture that is newly supplied via the scavenging passage, it is possible to prevent the gaseous mixture from being mixed into the combustion gas, and to thereby prevent blow-by of unburned gas through an exhaust port.

Here, such stratified two-stroke engines are roughly categorized into the following two types according to the method for restricting air flow from the air passage to the scavenging passage.

In one of the categorized stratified two-stroke engines, a check valve is provided in an air passage, which permits a flow of air from the air passage toward the scavenging passage and inhibits a flow of air and the gaseous mixture in the opposite direction, that is, a flow from the scavenging passage through the air passage toward the outside.

In the other of the categorized stratified two-stroke engines, a groove is formed on a side surface of a piston, through which the scavenging passage temporarily communicates with the air passage to supply air into the scavenging passage, and the air passage is closed by the piston at a time of supplying the gaseous mixture to the inside of the cylinder.

WO 2010/035684 discloses a stratified two-stroke engine of the former type.

In the stratified two-stroke engine disclosed in the above document, to a scavenging passage extending from a scavenging intake that opens to the inside of a crankcase to a scavenging port that opens to the inside of a cylinder, an air passage for supplying air for pre-scavenging is connected at a substantially intermediate position between the scavenging intake and the scavenging port. Furthermore, in the connecting portion of the air passage with the scavenging passage, there is provided a check valve (for example, a reed valve) which inhibits a reverse flow from the scavenging passage to the air passage. The engine has a piston having a lower surface into which a cutout is formed so that the scavenging port opens through the cutout in a transition period from a late stage of an upward stroke to an initial stage of a downward stroke. Accordingly, a negative pressure generated inside of the crankcase propagates through the scavenging port into the scavenging passage, so that air for pre-scavenging is supplied from the air passage to the scavenging passage. Here, in order to prevent the negative pressure inside of the crankcase from propagating into the scavenging passage through the scavenging intake, the scavenging intake is provided with a check valve (for example, a reed valve) which inhibits a flow of air from the scavenging passage to the inside of the crankcase.

According to such a construction, the air, that has been supplied into the scavenging passage, flows through the scavenging passage in one direction toward the scavenging port without flowing from the connecting portion with the air passage toward the scavenging intake. Accordingly, since mixing of a gaseous mixture into the air for pre-scavenging is suppressed, stratified separation between the air and the gaseous mixture is maintained, and blow-by of unburned gas through an exhaust port is thereby prevented.

SUMMARY OF THE INVENTION

In order to achieve a further preferable air-preceding type stratified scavenging, it is a object of the present invention to store as large amount of air as possible for pre-scavenging in the scavenging passage, to thereby prevent blow-by of unburned gas through an exhaust port.

In order to achieve the above object, the a stratified scavenging two-stroke engine according to an aspect of the present invention includes an intake passage that supplies a gaseous mixture of fuel and air to the inside of a crankcase; a first scavenging passage that extends from a first scavenging intake that opens to the inside of the crankcase to a first scavenging port that opens to the inside of a cylinder according to movement of the position of a piston; a second scavenging passage that extends from a second scavenging intake that opens to the inside of the crankcase to a second scavenging port that opens to the inside of the cylinder according to movement of the position of the piston; a communicating portion through which the first scavenging passage and the second scavenging passage communicate with each other; an air passage that supplies air for pre-scavenging into the first scavenging passage at a position closer to the first scavenging intake than the communicating portion; a first check valve that inhibits a flow of air from the first scavenging passage to the inside of the crankcase during an upward stroke of the piston; and a second check valve that inhibits a flow of air and the gaseous mixture from the first scavenging passage through the air passage to the outside during a downward stroke of the piston.

The engine is configured so that during the upward stroke of the piston, the gaseous mixture is supplied from the intake passage to the inside of the crankcase, and the air, that has been supplied through the air passage into the first scavenging passage, flows through the communicating portion into the second scavenging passage; and the engine is configured so that during the downward stroke of the piston, the air, that has entered into the first and the second scavenging passages during the upward stroke of the piston, flows through the first and the second scavenging ports to the inside of the cylinder, so that the gaseous mixture inside of the crankcase is supplied through the first and the second scavenging passages and the first and the second scavenging ports to the inside of the cylinder.

According to the present invention, in addition to the first scavenging passage to which air for pre-scavenging is directly supplied from the air passage, a second scavenging passage to which the air is supplied from the air passage through the first scavenging passage and the communicating portion is provided, so that the air is stored both in the first and the second scavenging passages and supplied to the inside of a cylinder from both of these passages. Accordingly, as compared with a case in which only a construction corresponding to the first scavenging passage is provided as the scavenging passage, it is possible to store a larger amount of air for pre-scavenging and to thereby suppress blow-by of unburned gas.

Other objects and features of aspects of the present invention will be understood from the following description with reference to the accompanying drawings.

DESCRIPTION OF THE PREFERRED EMBODIMENTS

Figure 1:
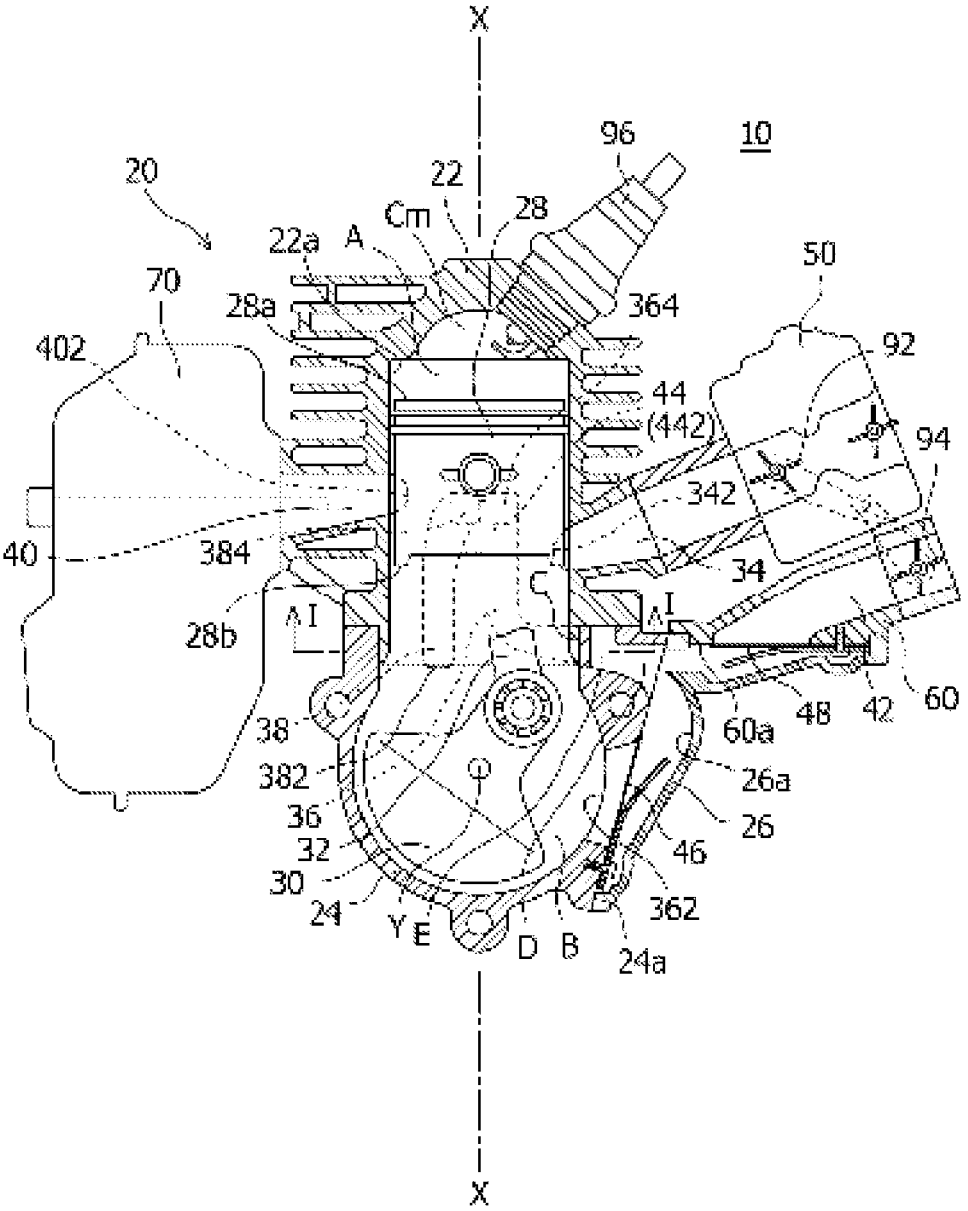
FIG. 1 is a construction view of a stratified scavenging two-stroke engine according to a first embodiment of the present invention.

FIG. 1 is a cross-sectional view showing an entire construction of a stratified scavenging two-stroke engine 10 (hereinafter simply referred to as "engine") according to a first embodiment of the present invention.

The engine 10 is a single cylinder type small-sized two-stroke engine, which is applicable as a drive source for various types of portable working machines such as chainsaws or blowers, that are used as they are held by users' hands or on users' shoulders.

The engine 10 is constituted by, as main constituents, an engine main body 20, a fuel-adding device (carburetor in this embodiment) 50, an air duct 60 and an exhaust muffler 70. The engine main body 20 is constituted by a cylinder 22, a crankcase 24 and a crankcase cover 26, in which the crankcase 24 is fixed to a lower portion of the cylinder 22, and the crankcase cover 26 is fixed to a side portion of the crankcase 24. The cylinder 22 houses a piston 28 so that it can reciprocate up and down, and the crankcase 24 houses a crankshaft 30 so as to be rotatable. The piston 28 and the crankshaft 30 are joined with each other via a connecting rod 32 (only a broken part of which is illustrated), so that the up-down movement of the piston 28 is converted to rotational movement of the crankshaft 30. The crankshaft 30 has one end extending to the outside of the crankcase 24, so that the rotational movement of the crankshaft 30 can be taken out as an output of the engine 10.

In the engine main body 20, an intake passage 34, scavenging passages 36 and 38, and an exhaust passage 40 are formed. In this embodiment, these passages 34 to 40 each has one end that opens to the inside of the cylinder 22 (a space indicated by a symbol A in FIG. 1, hereinafter referred to as "inside of the cylinder"), open and close of these passages 34 to 40 to the inside of the cylinder 22 is controlled by the piston 28.

The intake passage 34 communicates with the inside of the cylinder 22 via a suction port 342, the upper edge of the suction port 342 is located below an upper surface 28*a* of the piston 28 when it is at the bottom dead center, and the lower edge of the suction port 342 is located below a lower surface 28*b* of the piston 28 when it is at the top dead center. Accordingly, the intake passage 34 is closed by the piston 28 when the piston 28 is at the bottom dead center, and opened below the piston 28 in a period from the middle stage in the upward stroke to the middle stage in the downward stroke, so that a negative pressure generated inside of the crankcase 24 (a space indicated by a symbol B in FIG. 1, which may include a space in the cylinder 22 below the piston 28; hereinafter referred to as "inside of the crankcase") is supplied into the passage 34 to draw a gaseous mixture. Here, the upward stroke means a stroke in which the piston 28 moves from the bottom dead center to the top dead center, and the downward stroke means a stroke in which the piston 28 moves from the top dead center to the bottom dead center. The suction port 342 is not necessarily formed in the cylinder 22 but it may be formed in the crankcase 24, and in such a case, the suction port 342 is provided with a check valve to prevent reverse flow of the gaseous mixture from the inside of the crankcase 24.

The scavenging passage includes a first scavenging passage 36 and a second scavenging 38, the first and the second scavenging passages 36 and 38 communicate with the inside of the crankcase 24 via scavenging intakes 362 and 382, at the respective one ends thereof, and communicate with the inside of the cylinder 22 via scavenging ports 364 and 384, at the respective other ends thereof, so as to spatially connect the inside of the crankcase 24 with the inside of the cylinder 22.

Specifically, the first scavenging passage 36 extends upwardly in S-shape from the first scavenging intake 362 formed in the crankcase 24, and is connected to the first scavenging port 364 formed in the cylinder 22. In this embodiment, the first scavenging intake 362 is formed so as to penetrate from the inside to the outside through a portion of the crankcase 24 present in a direction perpendicular to the axis Y of the crankshaft 30.

Figure 2:
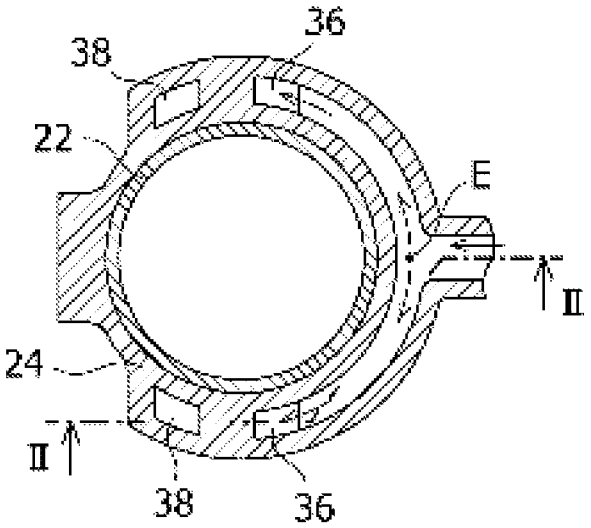
FIG. 2 is a cross-sectional view of the engine with respect to a section along I-I line shown in FIG. 1.

A portion of the first scavenging passage 36 below a connecting portion C of the cylinder 22 with the crankcase 24 is formed outside the crankcase 24 by an inner surface 26*a* of the crankcase cover 26, and a portion of the first scavenging passage 36 above the connecting portion C is formed inside a side wall of the cylinder 22. As shown in FIG. 2, the first scavenging passage 36 branches into two directions at a position on the downstream side of a connecting portion D with an air passage 42 to be described later. Two first scavenging ports 364 are formed on respective sides across the axis X of the cylinder 22, and the first scavenging passage 36 has branches extending from a branch point E toward the downstream side and connected to the respective first scavenging ports 364.

The second scavenging passage 38 extends upwardly along the axis X of the cylinder 22 from the second scavenging intake 382 formed in the crankcase 24, and is connected to the second scavenging port 384 formed in the cylinder 22. In this embodiment, the second scavenging intake 382 is formed so as to penetrate vertically through a circumferential wall of the crankcase 24 fitted with an end portion of the cylinder 22 at the connecting portion C (FIG. 2). The second scavenging passage 38 is formed inside the circumferential wall of the crankcase 24 in a region of the connecting portion C, and is formed inside a side wall of the cylinder 22 in substantially all region of the second scavenging passage 38 except the above region. In the same manner as the first scavenging ports 364, two second scavenging ports 384 are formed on respective sides across the axis X of the cylinder 22, and two second scavenging passages 38 are connected to respective second scavenging ports 384.

Figure 3:
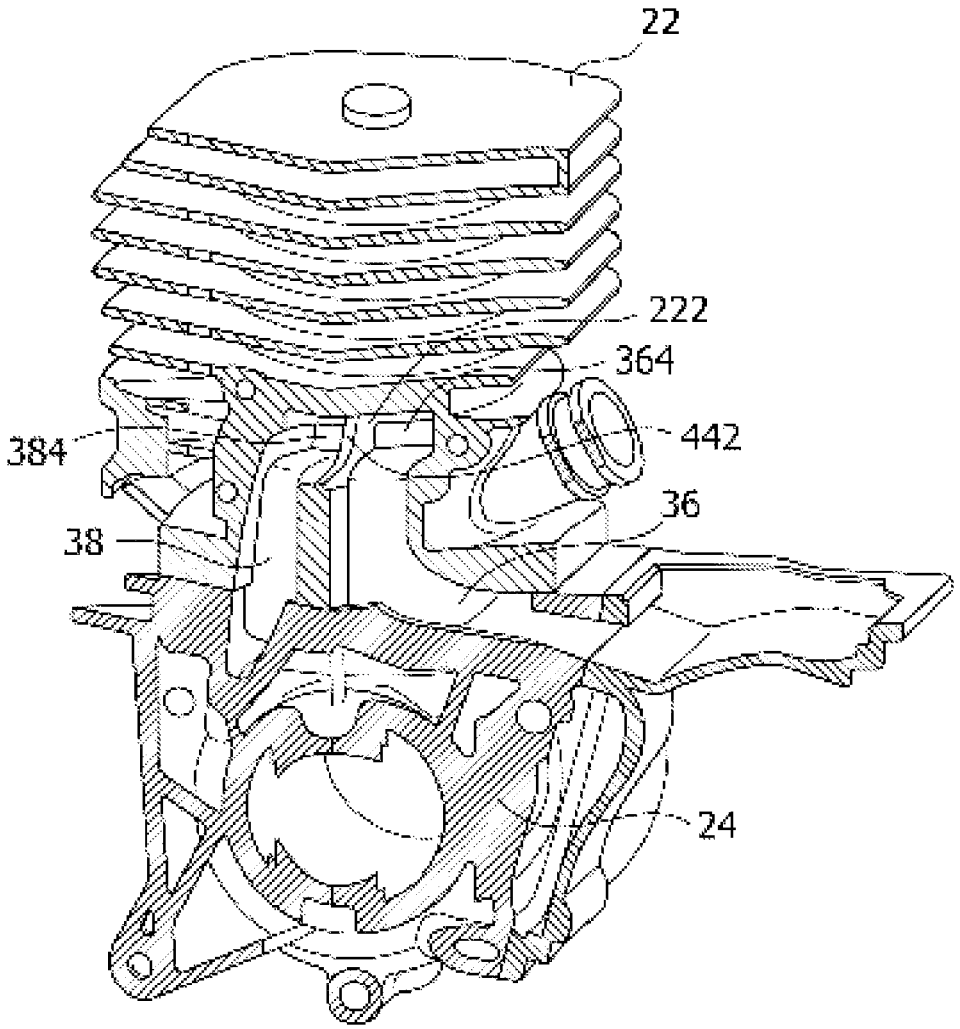
FIG. 3 is a cross-sectional perspective view of the engine with respect to a section along II-II line shown in FIG. 2.

The first and the second scavenging ports 364 and 384 are formed adjacently to each other in the circumferential direction around the axis X of the cylinder 22, and as shown in FIG. 3, they are separated from each other by a wall portion 222 continuing from an inner wall 22*a* of the cylinder 22, to form independent openings in the inner surface 22*a* of the cylinder 22.

Returning to FIG. 1, the upper edges of the first and the second scavenging ports 364 and 384 are located above the upper surface 28*a* of the piston 28 when it is at bottom dead center, and their lower edges are located above the lower surface 28*b* of the piston 28 when it is at the top dead center. In this embodiment, a slight cutout is formed on the lower surface 28*b* of the piston 28, and the lower edges of the first and the second scavenging ports 364 and 384 are located above the recessed surface of the cutout when the piston 28 is at the top dead center.

Accordingly, when the first and the second scavenging ports 364 and 384 open above the piston 28 in the last stage of the downward stroke of the piston, the inside of the crankcase communicates with the inside of the cylinder 22 through the first and the second scavenging passages 36 and 38 so as to form passages for supplying a gaseous mixture inside of the crankcase 24 to the inside of the cylinder 22. On the other hand, in the entire period including the timing at which the piston 28 is at upper dead center except for the initial stage of the upward stroke and the last stage of the downward stroke, the first and the second scavenging ports 364 and 384 are closed by the piston 28.

The first scavenging passage 36 and the second scavenging passage 38 form the respective independent openings (first and second scavenging ports 364 and 384) in the inner surface 22*a* of the cylinder 22, and they communicate with each other in a region slightly outside thereof, to form a continuous passage 36, 44 and 38 from the first scavenging intake 362 via the communicating portion 44 to the second scavenging intake 382. As shown in FIG. 3, in this embodiment, a cutout hole (corresponding to "first cutout hole") 442 is formed through a wall portion 222 of the cylinder 22 separating the first scavenging passage 36 and the second scavenging passage 38 in the vicinity of the first and the second scavenging ports 364 and 384, and the first and the second scavenging passages 36 and 38 communicate via the cutout hole 442.

The exhaust passage 40 communicates with the inside of the cylinder 22 via an exhaust port 402, and the upper edge of the exhaust port 402 is located above the upper surface 28*a* of the piston 28 when it is at the bottom dead center, and the lower edge of the exhaust port 402 is located above the lower surface 28*b* of the piston 28 when it is at the top dead center. Accordingly, the exhaust passage 40 is closed by the piston 28 when the piston 28 is at the top dead center, and the exhaust passage 40 opens to the inside of the cylinder 22 prior to open of the first and the second scavenging ports 364 and 385, to exhaust a combustion gas to lower the pressure inside of the cylinder 22 on and after the middle stage of the downward stroke of the piston 28.

In this embodiment, an air duct 60 is attached to an upper portion of the crankcase cover 26. An air passage 42 is formed by the crankcase cover 26 and the air duct 60, and is connected to a portion of the first scavenging passage 36 closer to the first scavenging intake 362 than the cutout hole 442, specifically, a substantially intermediate portion between the first scavenging intake 362 and the first scavenging port 364. The first scavenging passage 36 is formed so as to curve in S-shape and the air passage 42 is connected to the intermediate portion of the first scavenging passage 36, whereby these passages 42 and 36 linearly extend from the connecting portion D to the branch portion E of the first scavenging passage 36.

The first scavenging passage 36 is provided with a check valve (corresponding to "first check valve") 46 which prevents a negative pressure generated inside of the crankcase 24 from propagating to the first scavenging passage 36 via the first scavenging intake 362 at a time of supplying air to the scavenging passages 36 and 38. In this embodiment, a reed valve is employed as the check valve 46. An outer surface 24*a* of the crankcase 24 around the first scavenging intake 362 is formed flatly, and the reed valve 46 is attached so as to permit a flow from the inside of the crankcase 24 toward the first scavenging passage 36 while the reed valve 46 can inhibit a flow in the reverse direction.

The air passage 42 is provided with a check valve (corresponding to "second check valve") 48 which prevents the air and the gaseous mixture from flowing into the air passage 42 at a time of scavenging the inside of the cylinder 22. In this embodiment, a reed valve is employed as the check valve 48. A lower surface 60*a* of a connecting portion of the air duct 60 with the crankcase cover 26 is formed flatly, and the reed valve 46 is attached to the flat surface 60*a* so as to permit a flow from the air passage 42 toward the first scavenging passage 36 while the reed valve 46 can inhibit a flow in the reverse direction.

In addition to the above, an intake passage 34 is provided with a fuel adjustment valve 92 which adjusts a fuel supply amount to the engine 10. In this embodiment, the fuel adjustment valve 92 is included in a carburetor 50.

The air passage 42 is provided with an air adjustment valve 94 which adjusts a flow rate of air passing through the air passage 42. In this embodiment, the air adjustment valve 94 is connected to the above-mentioned fuel adjustment valve 92 so as to interlock with each other.

The cylinder 22 has a top portion to which an ignition plug 96 is attached. The ignition plug 96 operates to ignite a gaseous mixture in a combustion chamber Cm when the piston 28 is at the top dead center or its vicinity.

The exhaust passage 40 is provided with an exhaust muffler 70. A combustion gas produced by combustion passes through the exhaust passage 40 and discharged via the exhaust muffler to the atmosphere.

Operation of the stratified scavenging two-stroke engine 10 according to this embodiment will be described with reference to FIGS. 4 to 9.

FIGS. 4 to 8 illustrate operation of the engine 10 in the temporal sequence order, in which non-filled circles (○) indicate air, black filled circles (•) indicate a gaseous mixture and X marks (×) indicate a combustion gas. FIG. 9 shows port timings of the engine 10, in which the left section of the view indicates intake, scavenging and exhaust timings and the right section of the view indicates supplying timing of air.

A piston 28 present at the bottom dead center starts to move toward the top dead center when the operation transits to the upward stroke. Since the communication between the inside of the engine 10 and the outside (of the engine 10) is blocked by the piston 28, a negative pressure is generated inside of the crankcase 24, and the negative pressure is developed along with rise of the piston 28. In this embodiment, since the first scavenging passage 36 always communicates with the second scavenging passage 38 via a cutout hole 442 being a "first cutout hole", the negative pressure generated inside of the crankcase 24 propagates through the second scavenging passage 38 from the second scavenging intake 382 toward the second scavenging port 384, and further propagates to the first scavenging passage 36 via the cutout hole 442 during the entire piston stroke, to open the reed valve 48 (hatched portion on the right side in FIG. 9). Here, in this embodiment, since the first scavenging intake 362 is hermetically closed by the reed valve 46 being the "first check valve", the negative pressure inside of the crankcase 24 does not propagate to the first scavenging passage 36 via the first scavenging intake 362.

Figure 4:
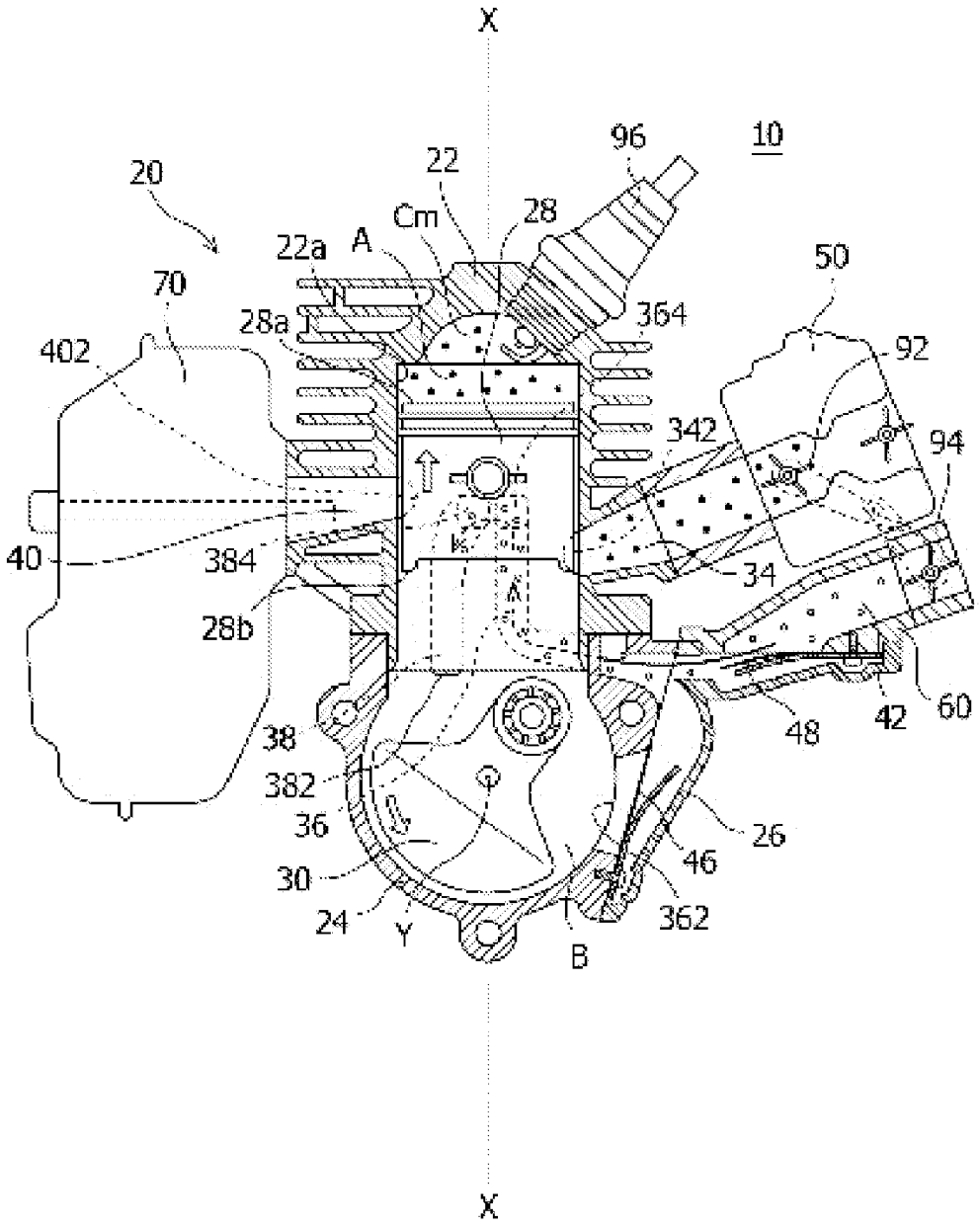
FIG. 4 is an operation explanation view of the engine (middle stage in upward stroke).

FIG. 4 illustrates operation in the middle stage of the upward stroke (point T1 in the left section in FIG. 9). Due to propagation of the negative pressure, the pressure in the first scavenging passage 36 drops below the atmospheric pressure, and the reed valve 48 being the "second check valve" opens to allow air to flow from the air passage 42 into the first scavenging passage 36. Some of the air flows into the second scavenging passage 38 via the cutout hole 442.

Figure 5:
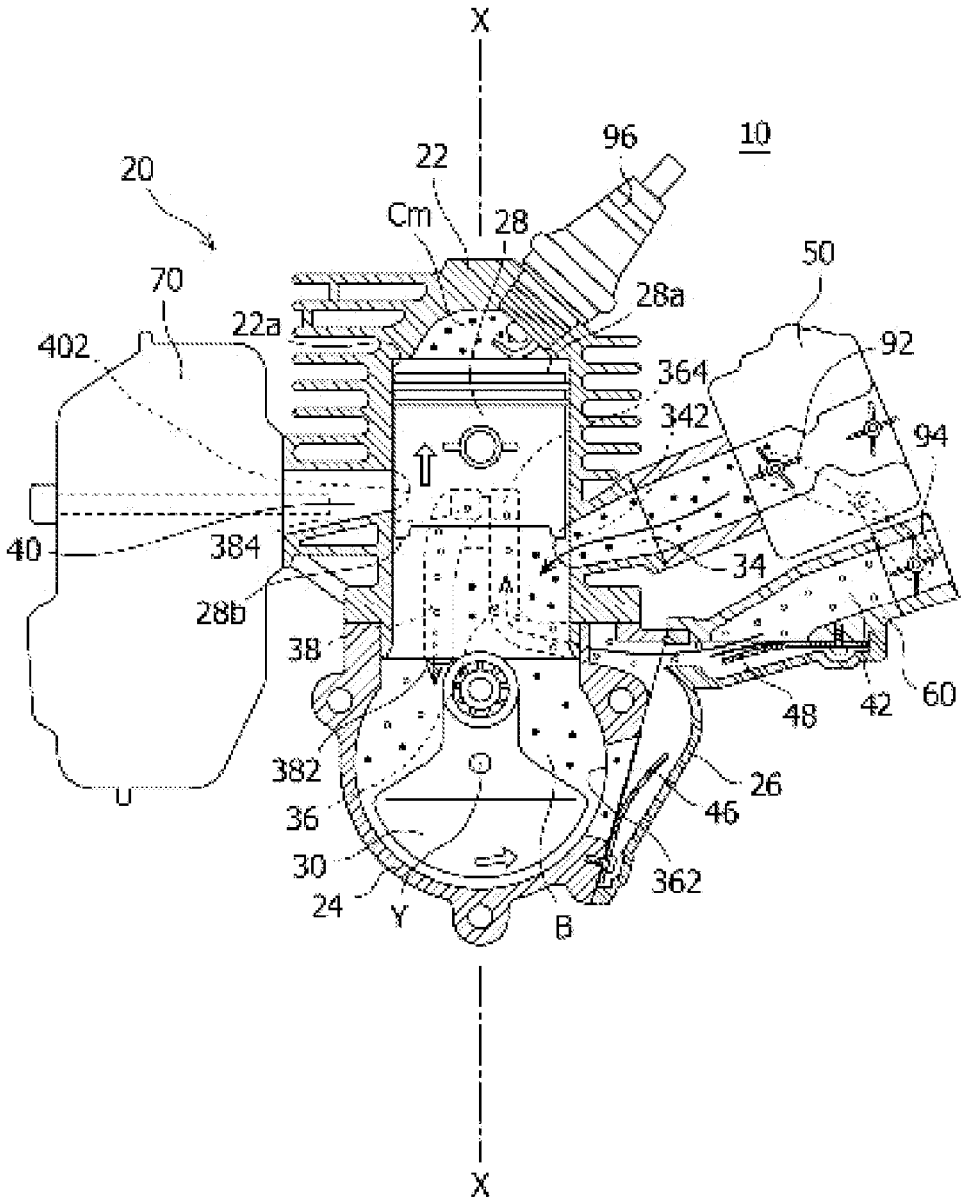
FIG. 5 is an operation explanation view of the engine (last stage in upward stroke).

FIG. 5 illustrates operation in the last stage of the upward stroke (point T2). The supplying of the air into the first and the second scavenging passages 36 and 38 has progressed and substantially the entire region of the scavenging passages 36 and 38 is filled with the air. Meanwhile, since the piston 28 has passed the suction port 342, the suction port 342 opens below the piston 28, and the negative pressure inside of the crankcase 24 is propagated via the suction port 342 into the intake passage 34. Accordingly, air outside the engine 10 is taken into the carburetor 50, and a gaseous mixture of the fuel added by the carburetor 50 and the air is supplied to the inside of the crankcase 24 via the intake passage 34.

When the piston 28 reaches the top dead center, an ignition plug 96 operates to ignite a gaseous mixture in the combustion chamber Cm. This gaseous mixture has been supplied to the inside of the cylinder 22 in the previous cycle.

When the operation transits to the downward stroke, the piston 28 is pushed down by volume expansion of the fuel, and this movement rotates a crankshaft 30 via a connecting rod 32. The rotational movement of the crankshaft 30 is taken out as an output of the engine 10.

Figure 6:
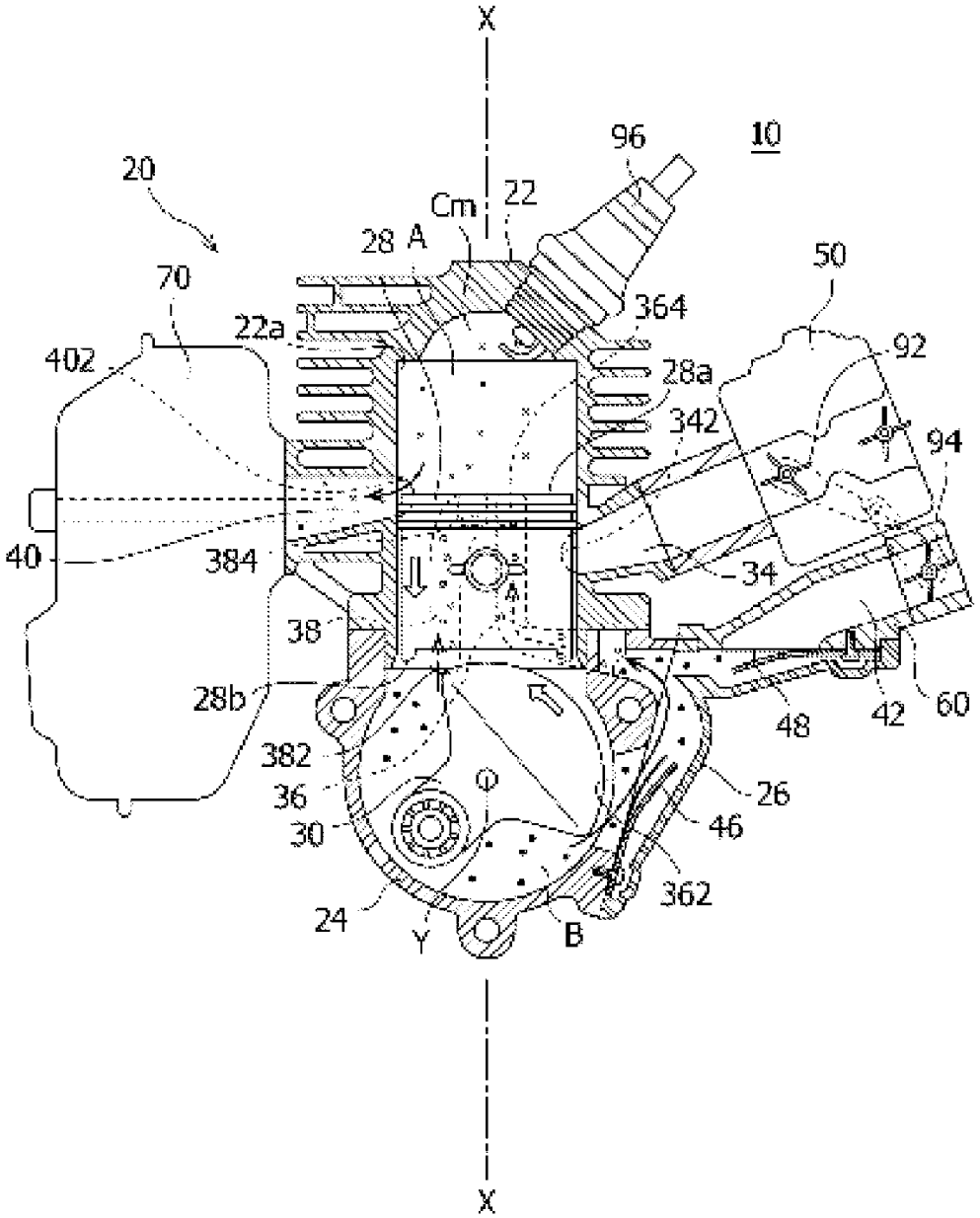
FIG. 6 is an operation explanation view of the engine (middle stage in downward stroke).

FIG. 6 illustrates operation in a middle stage of the downward stroke (point T3). Since the piston 28 has passed an exhaust port 402, the exhaust port 402 opens above the piston 28, and a combustion gas produced by the combustion is exhausted to the exhaust passage 40. Accordingly, the pressure in the cylinder 22 rapidly decreases. Meanwhile, inside of the crankcase 24, the gaseous mixture is compressed by drop of the piston 28 to raise the pressure. When the pressure inside of the crankcase 24 becomes higher than the pressure in the first scavenging passage 36, the reed valve 46 is opened to open the first scavenging intake 362, so that the gaseous mixture inside of the crankcase 24 flows through the first scavenging intake 362 into the first scavenging passage 36. The gaseous mixture inside of the crankcase 24 flows also through the second scavenging intake 382 into the second scavenging passage 38. In the middle stage of the downward stroke, since the first and the second scavenging ports 364 and 384 are still closed by the piston 28, the gaseous mixture that has flown into the first and the second scavenging passages 36 and 38 compresses the air in the passages 36 and 38 that has been supplied in the previous upward stroke. Here, in this embodiment, since the communication between the first scavenging passage 36 and the air passage 42 is hermetically blocked by the reed valve 48, the gaseous mixture in the first scavenging passage 36 does not flow out of the engine 10 through the air passage 42.

Figure 7:
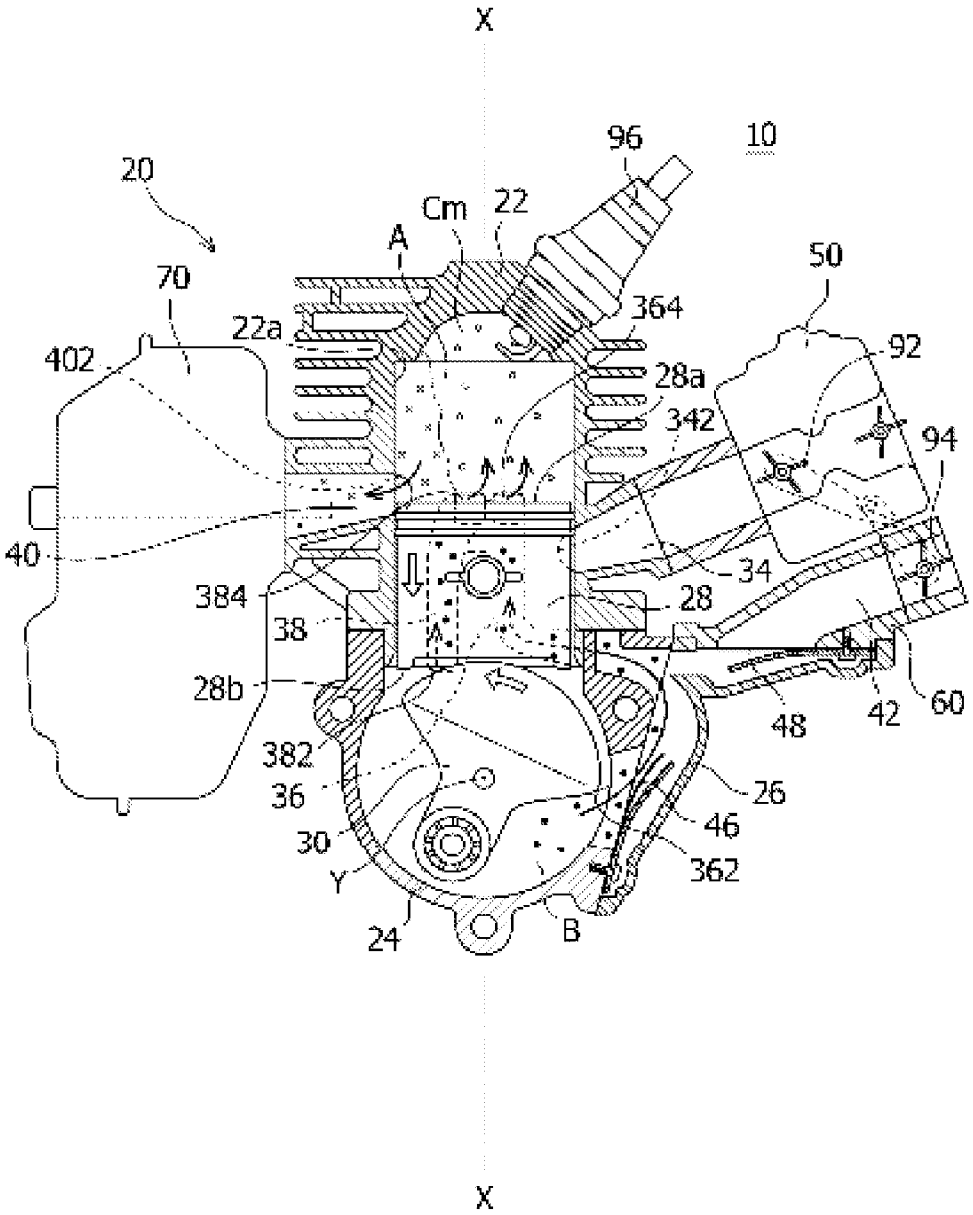
FIG. 7 is an operation explanation view of the engine (last stage in downward stroke).

FIG. 7 illustrates operation in a last stage of the downward stroke (point T4). When the piston 28 passes the first and the second scavenging ports 364 and 384, the first and the second scavenging ports 364 and 384 open above the piston 28 and air in the first and the second scavenging passages 36 and 38 flows to the inside of the cylinder 22 via the respective scavenging ports 364 and 384. An undischarged combustion gas remaining in the cylinder 22 is pre-scavenged by the air to promote discharge to the exhaust passage 40. Subsequently, a gaseous mixture in the first and the second passages 36 and 38 and a gaseous mixture inside of the crankcase 24 flow to the inside of the cylinder 22, and a combustion gas that is still remaining in the cylinder 22 even after the pre-scavenging and air that has flown to the inside of the cylinder 22 in advance are scavenged by the gaseous mixture. Here, since a layer of air is present between the combustion gas and the gaseous mixture, it is possible to prevent the gaseous mixture from flowing out to the exhaust passage 40 at a time of scavenging, and to prevent blow-by of unburned gas.

Figure 8:
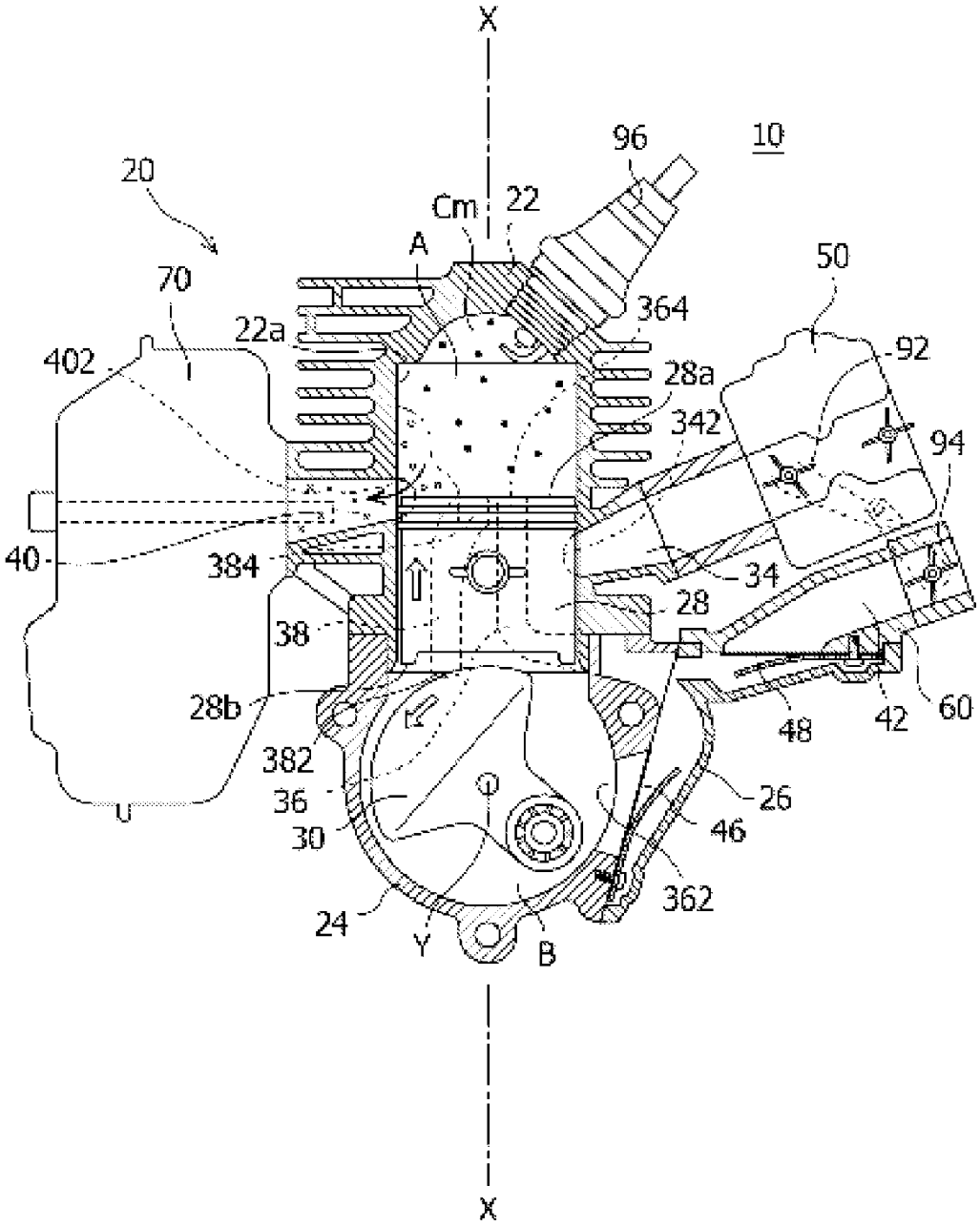
FIG. 8 is an operation explanation view of the engine (initial stage in upward stroke).
Figure 9:
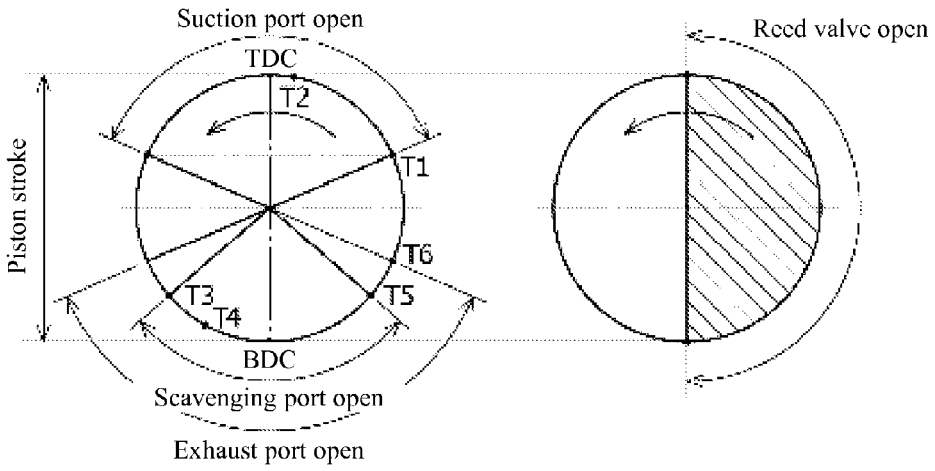
FIG. 9 is a port-timing view of the engine.

FIG. 8 illustrates operation in an initial stage of the upward stroke (point T5) in the next cycle. The first and the second scavenging ports 364 and 384 are closed by the piston 28 while the exhaust port 402 is still open and the air in the cylinder 22 is continuously scavenged. When the piston 28 further rises to close the exhaust port 402 (point T6), the inside of the cylinder 22 is hermetically closed and compression of the gaseous mixture is started.

This embodiment provides the following effects.

First, since the second scavenging passage 38 is provided in addition to the first scavenging passage 36 and these passages 36 and 38 are configured to communicate with each other via the cutout hole 442 (first cutout hole), it is possible to store air for pre-scavenging in both of the first and the second scavenging passages 36 and 38 and to supply the air to the inside of the cylinder 22. Accordingly, it is possible to obtain a sufficient amount of air for pre-scavenging and to achieve further preferable stratified scavenging.

Second, since the first scavenging passage 36 and the second scavenging passage 38 are configured to communicate with each other in the vicinity of the first and the second scavenging ports 364 and 384, it is possible to reduce, as much as possible, the amount of the gaseous mixture remaining over the end of each cycle in the vicinity of the first and the second scavenging ports 364 and 384, and to prevent the gaseous mixture from being mixed into the air for pre-scavenging.

Third, since the first scavenging passage 36 and the second scavenging passage 38 are configured to always communicate with each other via a cutout hole 442 formed through a wall portion of the cylinder 22, it is possible to obtain a sufficient time to supply the air into the scavenging passages 36 and 38.

Fourth, since the lower edges of the first and the second scavenging ports 364 and 384 are located above the lower surface 28*b* of the piston 28 (corresponding to the recessed surface of the cutout in this embodiment) present at the top dead center so that the ports 364 and 384 are closed by the piston 28 present at the top dead center, when the piston starts to drop from the top dead center, it is possible to prevent the gaseous mixture inside of the crankcase 24 from being pushed into the first and the second scavenging passages 36 and 38 through the first and the second scavenging ports 364 and 384 to be mixed into the air for pre-scavenging.

Hereunder, other embodiments of the present invention will be described mainly in their features.

Figure 10A:
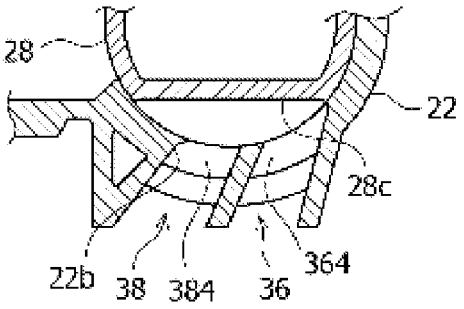
FIGS. 10A and 10B are a partial cross-sectional view of a stratified scavenging two-stroke engine according to a second embodiment of the present invention and a side view of a piston of the engine, respectively.
Figure 10B:
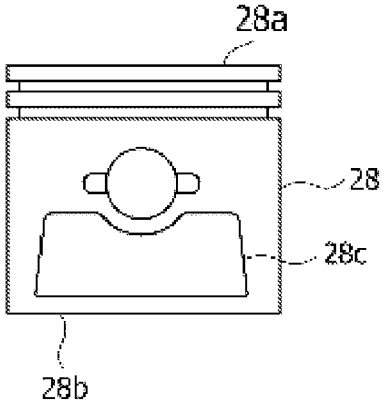
Figure 11:
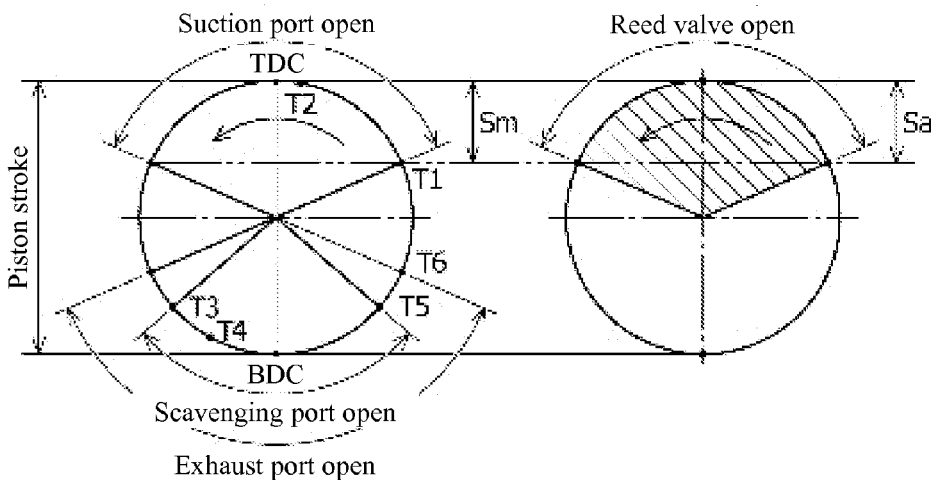
FIG. 11 is a port-timing view of the engine.

FIG. 10A is a partial cross-sectional view of a stratified scavenging two-stroke engine 10 according to a second embodiment of the present invention with respect to a section perpendicular to an axis of a cylinder 28, and FIG. 10B is a side view of the piston 28 provided in the engine 10. FIG. 11 shows port timings of the engine 10 according to this embodiment.

In this embodiment, a groove 28*c* is formed on a side surface of the piston 28, so that a first scavenging passage 36 and a second scavenging passage 38 communicate with each other via the groove 28*c* in a period from the last stage of the upward stroke to the initial stage of the downward stroke of the piston 28 (hatched portion on the right side of FIG. 11). Here, a period in which a suction port opens (piston stroke Sm) and a period in which first and the second scavenging passages 36 and 38 communicate with each other to open a reed valve of an air passage 42 (piston stroke Sa) are set to have substantially the same length. However, the construction is not necessarily limited thereto, and the former period (Sm) may be longer than the later period (Sa) or, on the contrary, the later period (Sa) is longer than the former period (Sm). The positions of the lower edges of first and the second scavenging ports 364 and 384 in this embodiment are set to be above the lower surface 28*b* of the piston 28 present at the top dead center, so that the first and the second scavenging ports 364 and 384 are always closed to the inside of a cylinder 22 by the piston 28 except for a period from the last stage of the downward stroke to the initial stage of the upward stroke in which the ports open above the piston 28. Accordingly, a negative pressure generated inside of the crankcase 24 along with rise of the piston 28 does not propagate via the first and the second scavenging ports 364 and 384 to the corresponding scavenging passages 36 and 38, but since the first and the second scavenging passages 36 and 38 communicate with each other via the groove 28*c*, the negative pressure propagates to the first scavenging passage 36 to supply air from the air passage 42 to the first scavenging passage 36. Further, some of the air is supplied into the second scavenging passage 38 via the groove 28*c*. The air in the first and the second scavenging passages 36 and 38 is sent to the inside of the cylinder 22 in the downward stroke of the piston 28 to scavenge the combustion gas in the cylinder 22 in the same manner as the first embodiment. The constructions of constituents such as a cylinder 22, a crankcase 24 and the crankcase cover 26 other than the piston 28 are similar to those of the first embodiment except that a cutout hole 442 being a "first cutout hole" is not formed on a wall portion of the cylinder 22. However, the construction may be such that both of the cutout hole 442 and the groove 28*c* are provided so that the first and the second scavenging passages 36 and 38 communicate with each other via both of the cutout hole 442 and the groove 28*c*.

According to this embodiment, since the first and the second scavenging passages 36 and 38 communicate with each other via the groove 28*c* of the piston 28, and the first and the second scavenging ports 364 and 384 are configured to be closed by the piston 28 present at the top dead center, when the piston starts to drop, it is possible to prevent the gaseous mixture inside of the crankcase 24 from being pushed into the first and the second scavenging passages 36 and 38 through the first and the second scavenging ports 364 and 384 and being mixed into the air for pre-scavenging.

Figure 12A:
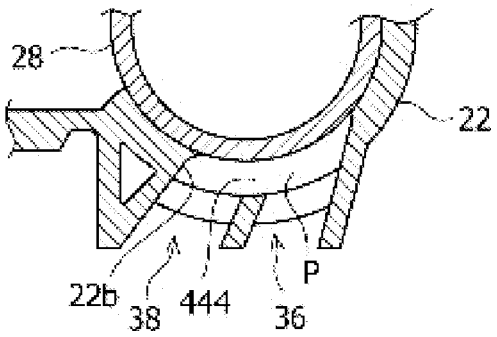
FIGS. 12A and 12B are a partial cross-sectional view of a stratified scavenging two-stroke engine according to a third embodiment of the present invention and a side view of a piston of the engine, respectively.
Figure 12B:
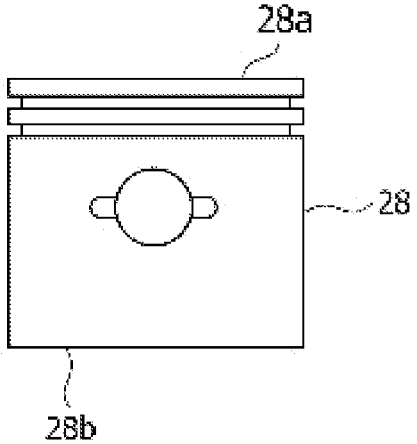

FIG. 12A is a partial cross-sectional view of a stratified scavenging two-stroke engine 10 according to a third embodiment of the present invention with respect to a section perpendicular to an axis of a cylinder 28, and FIG. 12B is a side view of the piston 28 provided in the engine 10.

In the first embodiment, the cutout hole 442 being a "first cutout hole" is formed by removing a portion of a wall portion of the cylinder 22 separating the first and the second scavenging passages 36 and 38 outside the first and the second scavenging ports 364 and 384, and the first and the second scavenging ports 364 and 384 themselves are partitioned by the wall portion 222 (FIG. 2) into two ports. In contrast, in this embodiment, since a "first cutout hole" (cutout hole 444) is formed by removing the wall portion of a cylinder 22 separating first and second scavenging ports 364 and 384, these scavenging ports communicate each other to form a continuous opening P at an inner surface of the cylinder 22. Accordingly, the first and second scavenging passages 36 and 38 always communicate with each other via the cutout hole 444 regardless of the position of the piston 28. The constructions of constituents such as a crankcase 24 and the crankcase cover 26 and the piston 28 other than the cylinder 22, are similar to those of the first embodiment. The construction of the cylinder 22 is similar to that of the first embodiment except for the position of the "first cutout hole".

According to this embodiment, since the first and the second scavenging passages 36 and 38 communicate with each other by removing the wall portion of the cylinder 22 separating the first and the second scavenging ports 364 and 384, at a time of supplying air into the scavenging passages 36 and 38, it is possible to eliminate retention of a flow of air in the vicinity of the first and the second scavenging ports 364 and 384 to thereby eliminate a gaseous mixture remaining in the vicinity of the scavenging ports from the previous cycle.

Figure 13:
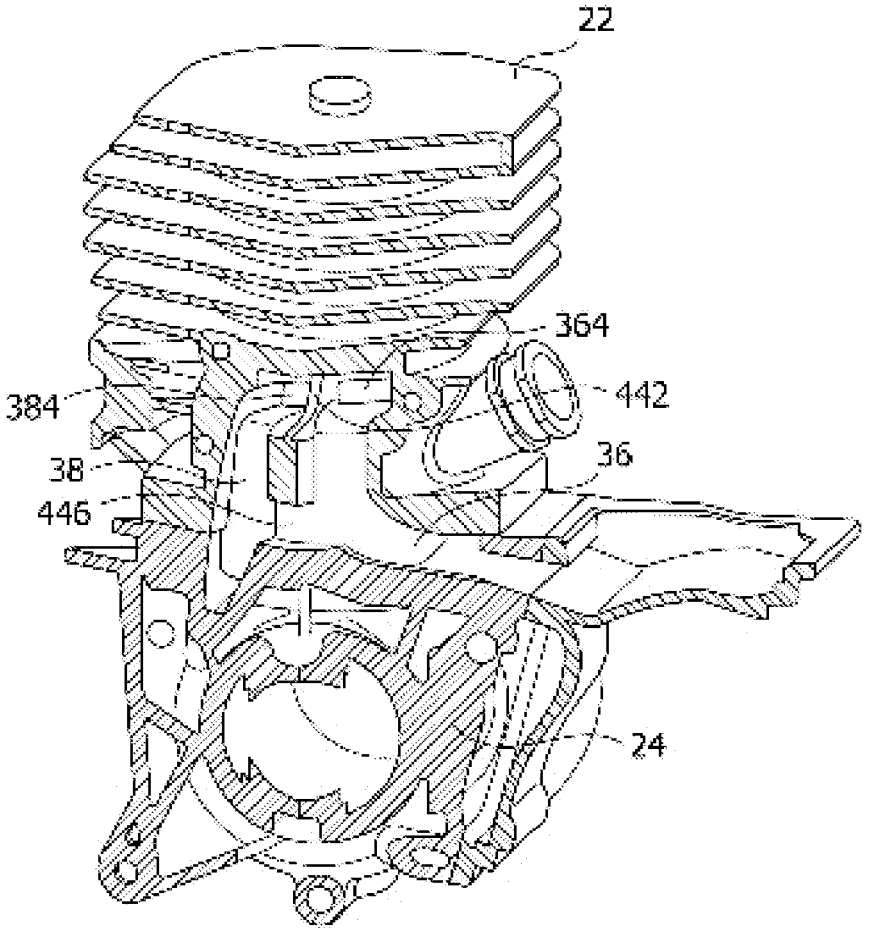
FIG. 13 is a cross-sectional view of a stratified scavenging two-stroke engine according to a fourth embodiment of the present invention.

FIG. 13 is a cross-sectional view of a stratified scavenging two-stroke engine 10 according to a fourth embodiment of the present invention with respect to a section in parallel to the axis of a cylinder 22.

In this embodiment, in addition to the construction of the first embodiment, a cutout hole (corresponding to a "second cutout hole") 446 is formed in a portion of a wall portion of the cylinder 22 separating the first and second scavenging passage 36 and 38 closer to the crankcase 24 than the cutout hole 444 being the "first cutout hole", specifically, in a portion on an extension of a line connecting a connecting portion D of an air passage 24 with the first scavenging passage 36 and a branch portion E of the first scavenging passage 36. Constructions other than the addition of the cutout hole 446 are similar to those of the first embodiment.

According to this embodiment, since the first and the second scavenging passages 36 and 38 communicate with each other via two cutout holes 442 and 446, it is possible to supply the negative pressure into the first scavenging passage 36 more smoothly to thereby obtain larger amount of air for pre-scavenging.

Figure 14:
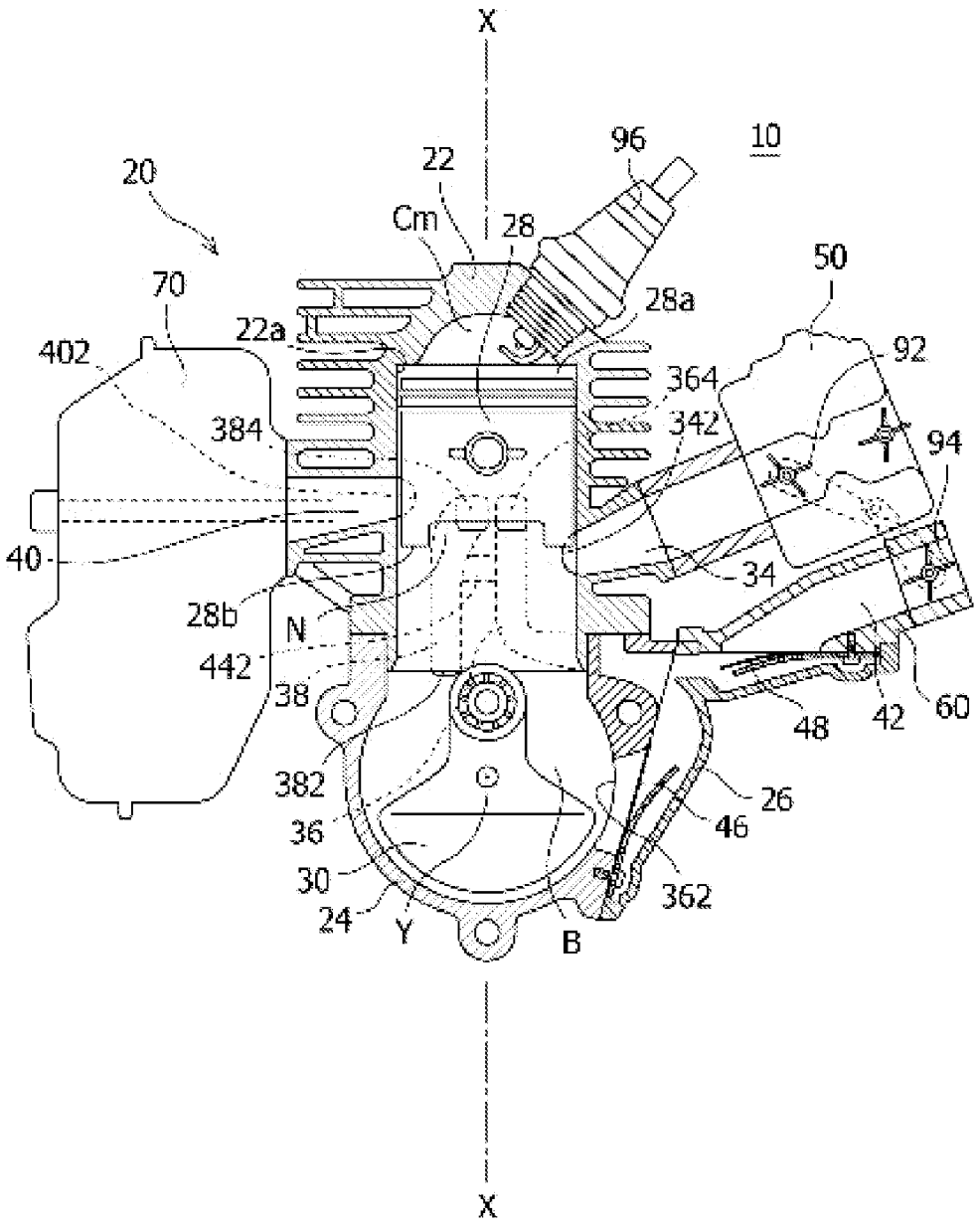
FIG. 14 is a construction view of a stratified scavenging two-stroke engine according to a fifth embodiment of the present invention.

FIG. 14 is an entire construction view of a stratified scavenging two-stroke engine 10 according to a fifth embodiment of the present invention.

In this embodiment, a cutout N is formed in the lower surface 28*b* of the piston 28, and the first and second scavenging ports 364 and 384 are configured so that they open through the cutout N when the piston 28 is at the top dead center or its vicinity. In other words, the lower edges of the first and the second scavenging ports 364 and 384 are set to be located below a recessed surface of the cutout N when the piston 28 is present at the top dead center. Accordingly, in this embodiment, in the last stage of the upward stroke of the piston 28, the inside of the crankcase 24 communicates with the first and second scavenging passages 36 and 38 via the first and the second scavenging ports 364 and 384, so that the negative pressure inside of the crankcase 24 propagates into the first and the second scavenging passages 36 and 38 via the first and the second scavenging ports 364 and 384. By adjusting the depth of the cutout N (dimension along the axis of the cylinder 22) to shorten a period in which the first and the second scavenging ports 364 and 384 open through the cutout N, it is possible to suppress mixing of a gaseous mixture into the scavenging passages 36 and 38 immediately after the piston 28 starts to move from the top dead center to the bottom dead center.

According to this embodiment, it is possible to draw a gaseous mixture of the previous cycle remaining in the vicinity of the first and the second scavenging ports 364 and 384 from the scavenging ports 364 and 384 to the inside of the cylinder 22, to thereby prevent the gaseous mixture from being mixed into air for pre-scavenging.

Moreover, according to this embodiment, since the first and the second scavenging ports 364 and 384 are temporarily opened, it becomes possible to eliminate the remaining gaseous mixture in the vicinity of the ports, and accordingly, it is possible to increase the degree of freedom at a time of determining the position of the "first cutout" connecting the first scavenging passage 36 and the second scavenging passage 38. In other words, it becomes possible to form the cutout hole 442 being the "first cutout hole" at a position distant from the first and the second scavenging ports 364 and 384. This feature is advantageous for maintaining the directivity of air and the gaseous mixture flowing from the first and the second scavenging passages 36 and 38 to the inside of the cylinder 22.

Figure 15:
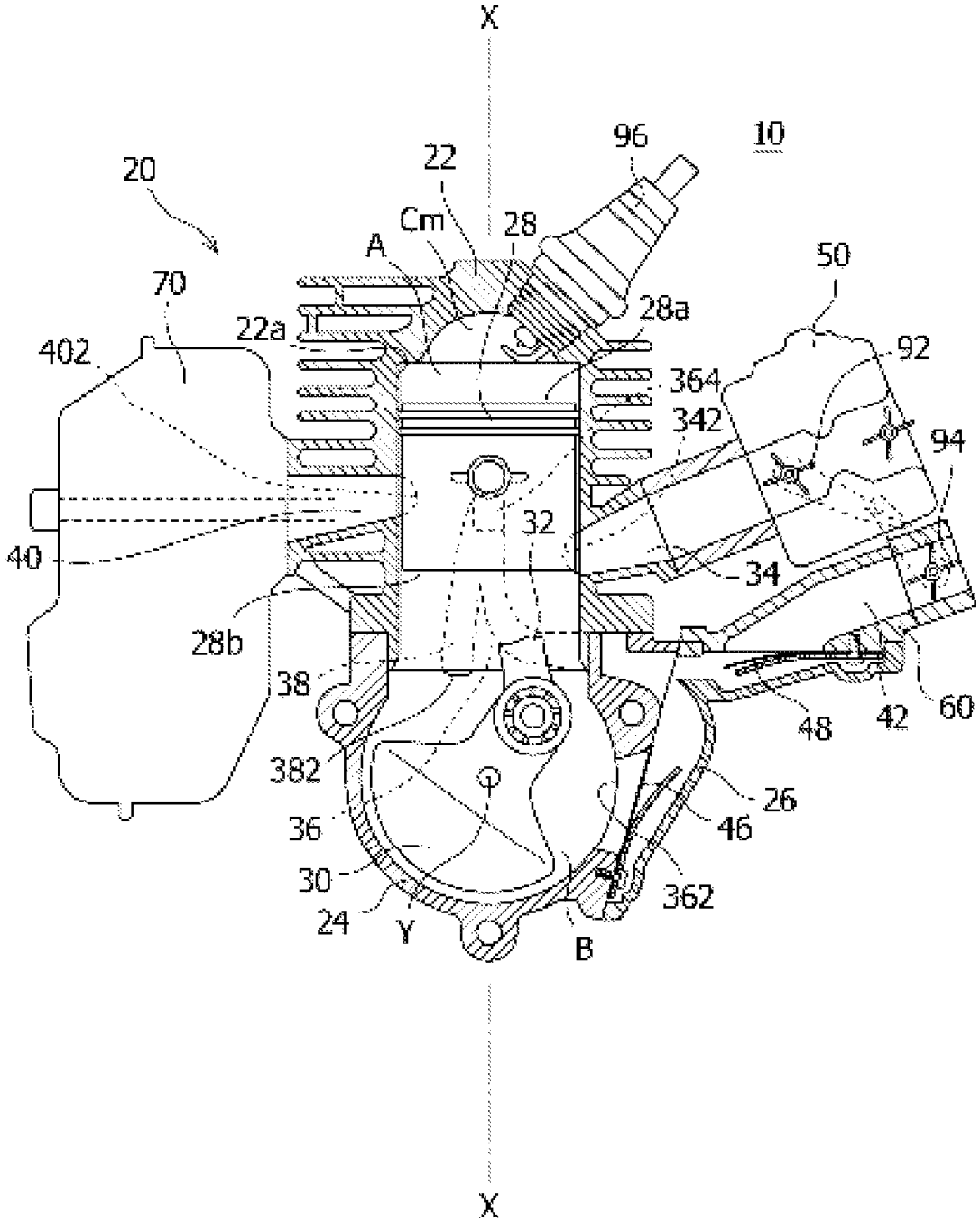
FIG. 15 is a construction view of a stratified scavenging two-stroke engine according to a sixth embodiment of the present invention.

FIG. 15 is an entire construction view of a stratified scavenging two-stroke engine 10 according to a sixth embodiment of the present invention.

In this embodiment, the first scavenging passage 36 extends from the first scavenging intake 362 to the first scavenging port 364 to connect the inside of the crankcase 24 with the inside of the cylinder 22, while the second scavenging passage 38 has one end communicating with the inside of the crankcase 24 via the second scavenging intake 382 and the other end connected to the first scavenging passage 36, so as to communicate with the inside of the cylinder 22 via the first scavenging port 364 as a common port with the second scavenging port 384. In other words, the scavenging passages 36 and 38 according to this embodiment extend commonly from a single scavenging port 364 opening to the inside of the cylinder 22, extend downwardly along the axis X of the cylinder 22, and branch into two directions. One branch opens to the inside of the crankcase 24 at a connecting portion C of the crankcase 24 with the cylinder 22 to form the second scavenging intake 382, while the other branch opens to the inside of the crankcase 24 at a side portion of the crankcase 24 to form the first scavenging intake 362. Accordingly, in this embodiment, in the downward stroke of the piston 28, air in the first and the second scavenging passages 36 and 38 flows to the inside of the cylinder 22 via the common scavenging port 364, and a gaseous mixture inside of the crankcase 24 is supplied through the first and the second scavenging passages 36 and 38 to the inside of the cylinder 22 via the common scavenging port 364. The constructions of constituents such as the piston 28, the crankcase 24 and the crankcase cover 26 other than the cylinder 22 are similar to those of the first embodiment. The constructions of constituents of the cylinder 22 such as an intake passage 34 and an exhaust passage 40 other than the scavenging passages 36 and 38 are similar to those of the first embodiment.

According to this embodiment, it is possible to form the second scavenging passage 38 even in a narrow space, and to increase the amount of air for pre-scavenging.

Figure 16:
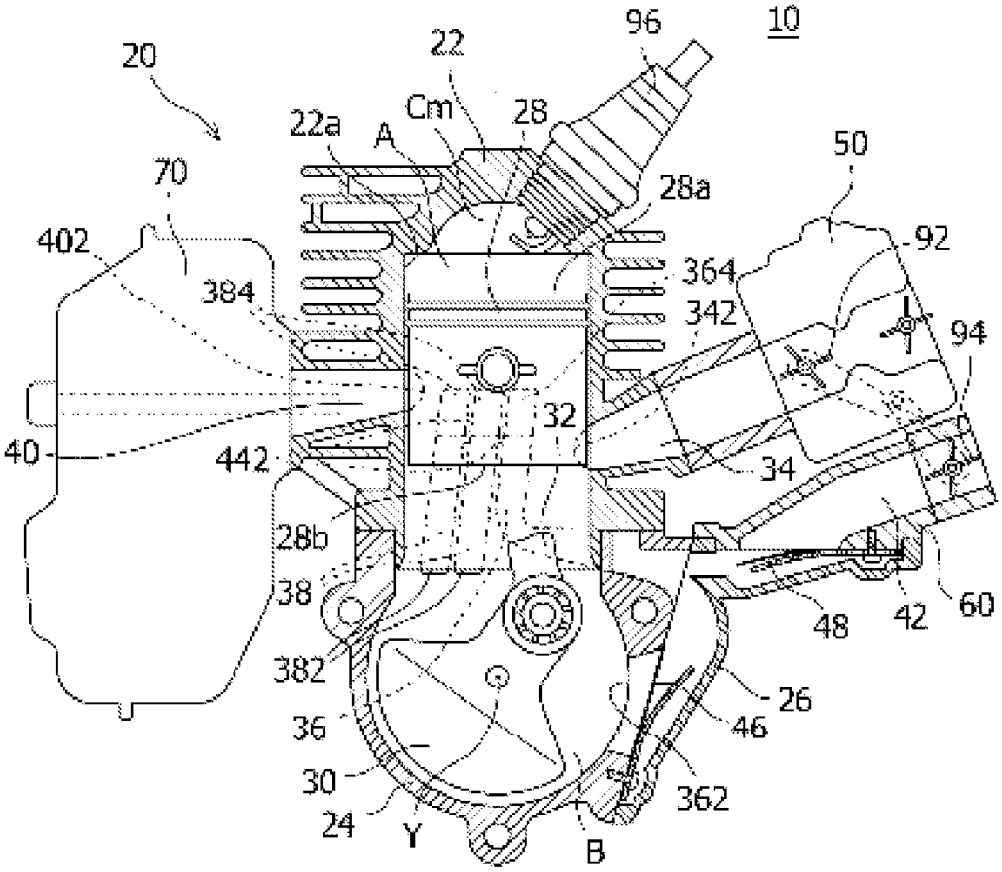
FIG. 16 is a construction view of a stratified scavenging two-stroke engine according to a seventh embodiment of the present invention.

FIG. 16 is an entire construction view of a stratified scavenging two-stroke engine 10 according to a seventh embodiment of the present invention.

In this embodiment, a single first scavenging passage 36 and a plurality of second scavenging passages 38, 38 are provided on each side of the axis X of a cylinder 22. The second scavenging passages 38, 38 extend from the respective second scavenging intakes 382 to the respective second scavenging ports 384 to connect the inside of a crankcase 24 with the inside of a cylinder 22, and they communicate with each other and with the first scavenging passage 36 via the cutout hole 442 (corresponding to "first cutout hole") formed in the cylinder 22. Accordingly, in this embodiment, in the upstream stroke of the piston 28, a negative pressure generated inside of the crankcase 24 propagates to the first scavenging passage 36 via each of the second scavenging passages 38, 38, air is supplied into the first scavenging passage 36 from an air passage 24, some of the air is further supplied into the second scavenging passages 38, 38 via the cutout hole 442, and as a result, the first and all of the second scavenging passages 36, 38, 38 are filled with the air. Furthermore, in the downward stroke of the piston 28, the air in the first and all of the second scavenging passages 36, 38, 38 flows to the inside of the cylinder 22 via the corresponding scavenging ports 364, 384, 384, and a gaseous mixture inside of the crankcase 24 is supplied to the inside of the cylinder 22 via the first and all of the second scavenging passages 36, 38, 38. Constructions of constituents other than the cylinder 22 and the crankcase 24 are similar to those of the first embodiment. The constructions of the cylinder 22 and the crankcase 24 are similar to those of the first embodiment except that a plurality of second scavenging passages 38 are provided and that a plurality of second scavenging intakes 382, second scavenging ports 384 and cutout holes 442 are provided so as to accompany the plurality of second scavenging passages 38. The first scavenging passage 36 and the second scavenging passages 38 may communicate with one another via a groove 28*c* formed on a side surface of the piston 28 in the same manner as the second embodiment instead of the cutout hole 442.

According to this embodiment, since the volume of the scavenging passages 36 and 38 increases and the substantial opening area of the second scavenging passage 30 increases to thereby rapidly supply air into the entire scavenging passages 36 and 38, it becomes possible to easily obtain a sufficient amount of air.

Figure 17:
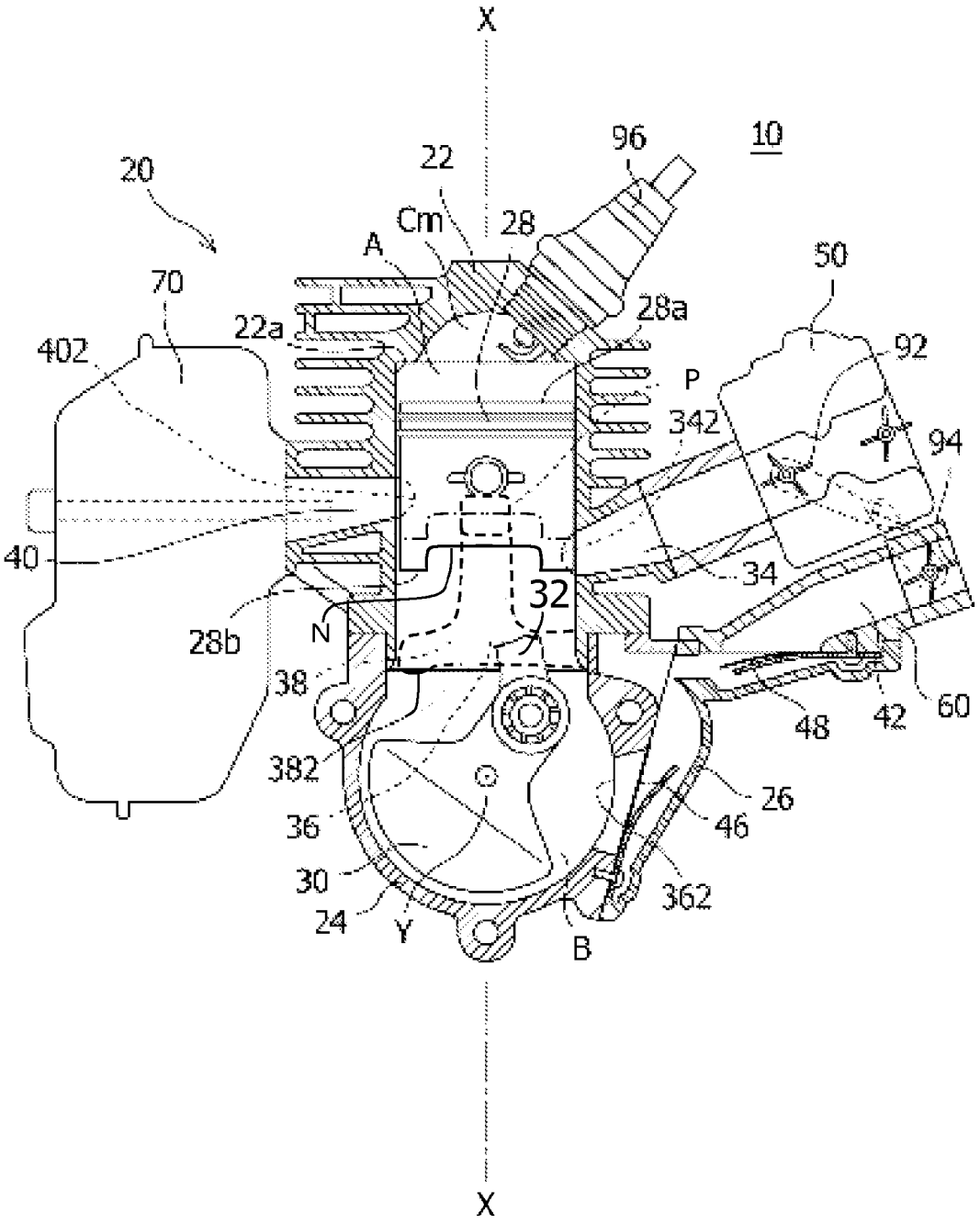
FIG. 17 is a construction view of a stratified scavenging two-stroke engine according to an eighth embodiment of the present invention.

FIG. 17 is an entire construction view of a stratified scavenging two-stroke engine 10 according to an eighth embodiment of the present invention.

In this embodiment, the first scavenging passage 36 extends from the first scavenging intake 362 that opens to the inside of the crankcase 24 and to a scavenging port P that opens to the inside of a cylinder 22 according to position movement of the piston, and the second scavenging passage 38 branches from an intermediate position of the first scavenging passage 36 and extends to the second scavenging intake 382 that opens to the inside of the crankcase 24.

Here, the intermediate position at which the second scavenging passage 38 branches from the first scavenging passage 36 is located closely to an upper end of the crankcase 24 in a lower end portion of the cylinder 22. A passage portion from the air passage 42, through the first scavenging passage 36 and the second scavenging passage 38 connected thereto at the intermediate position, to the second scavenging intake 382, is formed linearly in a direction substantially perpendicular to the axis of the cylinder 22. Meanwhile, a passage portion from the intermediate position of the first scavenging passage 36 to the scavenging port P is formed linearly in an axis direction of the cylinder 22.

Furthermore, the shape and the position of the scavenging port P is determined so that the scavenging port P opens through the cutout N of the piston 28 and communicates with the inside of the crankcase 24 via an inner space of the cylinder 22 under the piston 28 when the piston 28 is at the top dead center or its vicinity.

Operation of this embodiment will be described.

In an initial stage of the upward stroke of the piston 28, air is supplied from the air passage 42 into the first scavenging passage 36 and the second scavenging passage 38.

Here, since the passage portion from the air passage 42, to the intermediate position of the first scavenging passage 36 and the second scavenging passage 38, are formed linearly, the flow resistance of air is small and air flows smoothly. Accordingly, when the piston 28 rises, the air flows from the second scavenging intake 382 to the inside of the crankcase 24, so that some amount of air is stored also in a portion around the second scavenging intake 382.

Furthermore, when the piston rises to reach the top dead center or its vicinity, the scavenging port P opens through the cutout N of the piston 28 to communicate with the inside of the crankcase 24 via the inner space of the cylinder 22 under the piston 28. Accordingly, due to the negative pressure inside of the crankcase 24, the air is drawn up from the intermediate position of the first scavenging passage 36 to the scavenging port P, and such a portion is filled with the air. At the same time, some of a gaseous mixture remaining in the vicinity of the scavenging port P at the end of the previous downward stroke of the piston is pushed out into the inner space of the cylinder 22 communicating with the crankcase 24 under the piston 28 together with a gaseous mixture newly supplied from the intake passage 34, and is stored in an inner space of the cylinder 22. Some of the gaseous mixture is burned together with the new gaseous mixture, and it is possible to prevent such a gaseous mixture from flowing out as an unburned gas in the scavenging step.

Furthermore, when the operation of the piston 28 transits to the downward stroke and the scavenging port P opens into the combustion chamber Cm, first, air stored in a passage portion from the intermediate position of the first scavenging passage 36 to the scavenging port P flows into the combustion chamber Cm. Subsequently, air stored in a passage portion below the intermediate position of the first scavenging passage 36 and in the second scavenging passage 38, and air stored around the second scavenging intake 382 inside of the crankcase, sequentially flow into the combustion chamber Cm.

Subsequently, a gaseous mixture stored in an inner space of the cylinder 22 under the piston 28 is pushed to the inside of the crankcase 24 by descent of the piston 28, to be supplied through the first scavenging passage 36 and the second scavenging passage 38 into the combustion chamber Cm via the scavenging port P, and the supplied gaseous mixture is subjected to combustion.

Thus, according to this embodiment, it is possible to fill the first scavenging passage 36 and the second scavenging passage 38 with the air and to store some amount of air also around the second scavenging intake 382 inside of the crankcase 24, and to thereby obtain a larger amount of air for pre-scavenging and further enhance the preventive effect of blow-by of unburned gas.

Here, although not illustrated, in a linear passage portion of the first scavenging passage 36 and the second scavenging passage 38 along an upper edge portion of the crankcase 24, one or more holes opening to the inside of the crankcase 24 may be provided. In this configuration, it is possible to take air for pre-scavenging also through the hole into a portion around the hole in the crankcase 24, and in the downward stroke of the piston 28, it is possible to draw the air for pre-scavenging, that has been taken into the inside of the crankcase 24, through the hole into the first or the second scavenging passage 36 or 38 to supply the air into the combustion chamber Cm, to thereby obtain still larger amount of air for pre-scavenging.

Furthermore, in this embodiment, a construction in which the scavenging port P opens to the inside of the crankcase 24 through the cutout N of the piston 28 when the piston 28 is at the top dead center or its vicinity, but the construction may be such that the scavenging port P does not open to the inside of the crankcase 24 even when the piston 28 is at the top dead center.

Figure 18:
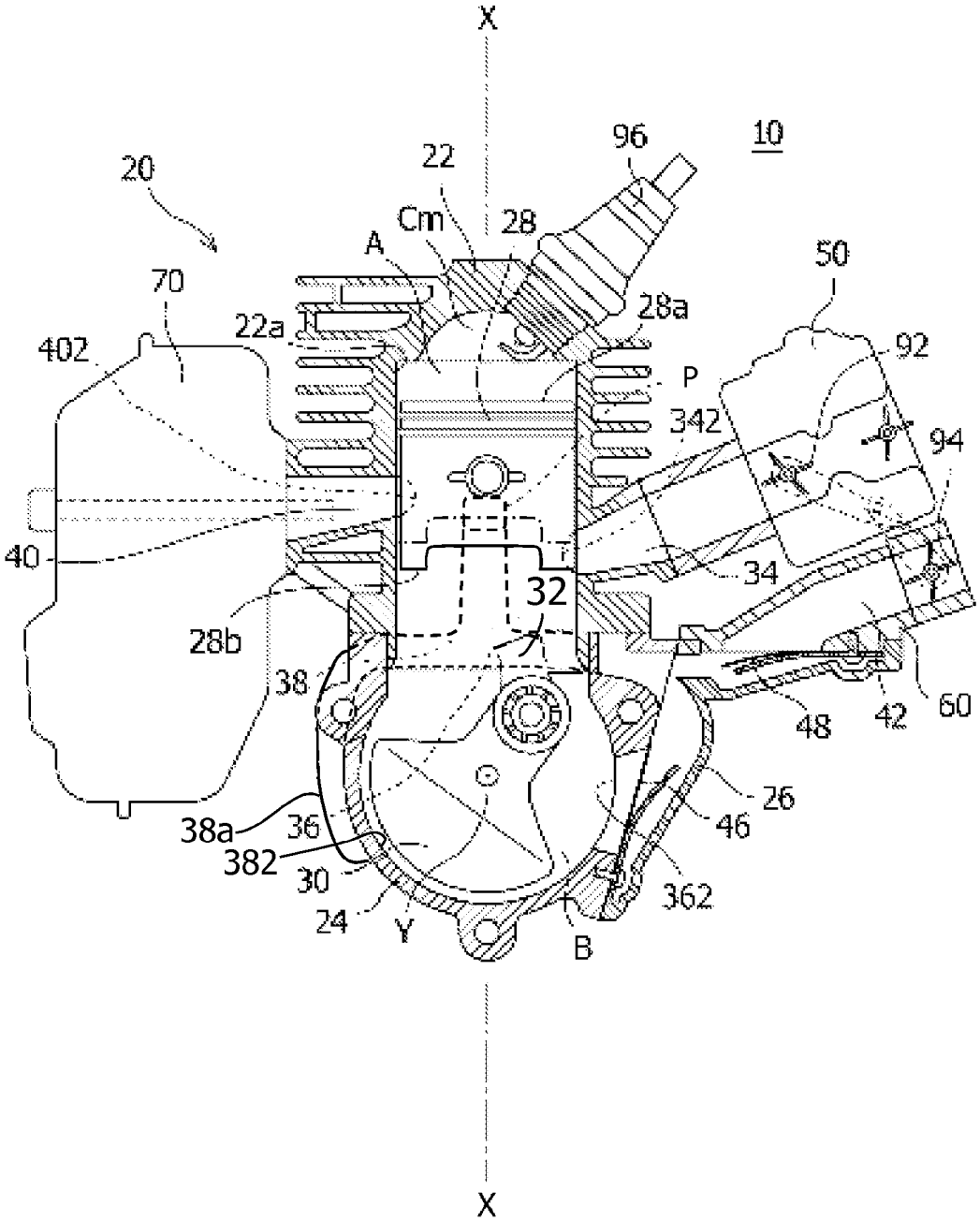
FIG. 18 is a construction view of a stratified scavenging two-stroke engine according to a ninth embodiment of the present invention.

FIG. 18 is an entire construction view of a stratified scavenging two-stroke engine 10 according to a ninth embodiment of the present invention.

In this embodiment, a part 38*a* of a second scavenging passage 38 (a downstream portion in the downward stroke of a piston 28) extends to a lower portion of a crankcase 24.

Other constructions are similar to those of the eighth embodiment, and furthermore, the characteristic construction of the ninth embodiment that a part of the second scavenging passage 38 extends to a lower portion of the crankcase 24 may be applied in the same manner also to the first to the seventh embodiments.

In such a construction, since it is possible to store the air for pre-scavenging also in the extended passage portion 38*a* of the second scavenging passage 38 to thereby store larger amount of the air for pre-scavenging in the scavenging passage in which the air is not mixed with a gaseous mixture, it is possible to enhance the effect of suppressing blow-by of unburned gas.

Furthermore, in FIG. 18, the part 38*a* of the second scavenging passage 38 extending to the lower portion of the crankcase 24 is formed along a wall of the crankcase 24, but the extended passage portion may be formed by connecting a tube (hose) to the outside of the wall.

In all of the above-described embodiments, on the wall portion of the cylinder 22 forming the second scavenging port 384 (the wall portion forming the single scavenging port Pin the examples illustrated in FIGS. 15, 17 and 18), a guide surface 22*b* may be formed so that a flow of the air and the gaseous mixture flowing to the inside of the cylinder 22 via the second scavenging passage 38 is inclined to a direction leaving from the exhaust port 40. FIG. 10 shows a guide surface 22*b* provided on a wall portion forming the second scavenging port 384, and FIG. 12 shows a guide surface 22*b* provided on a wall portion forming a single scavenging port P. According to such a construction, it is possible to suppress the generation of flow of the air and the gaseous mixture, that has been flown to the inside of the cylinder 22, toward directly to the exhaust port 40, to thereby achieve a preferable scavenging.

In the above explanations, explanations have been made with respect to examples employing reed valves as the first and the second check valves 46 and 48, but the construction is not limited thereto, and various valve means such as rotary valves or electromagnetic valves may be employed as the first and the second check valves 46 and 48. It is also possible to add a construction forming a valve to an outer peripheral surface of a counter weight of the crankshaft 30, to thereby close the first scavenging port 362.

The entire contents of Japanese Patent Application No. 2012-286765 filed on Dec. 28, 2012, on which priority is claimed, are incorporated herein by reference.

While only a select embodiment has been chosen to illustrate and describe the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and it is not for the purpose of limiting the invention, the invention as claimed in the appended claims and their equivalents.

What is claimed is:

1. A stratified scavenging two-stroke engine comprising:

an intake passage that supplies a gaseous mixture of fuel and air to an inside of a crankcase;

a first scavenging passage that extends from a first scavenging intake that opens to the inside of the crankcase to a scavenging port that opens to an inside of a cylinder according to movement of a position of a piston;

a second scavenging passage that branches from the first scavenging passage and extends to a second scavenging intake that opens to the inside of the crankcase, wherein the second scavenging passage has one end communicating with the inside of the crankcase via the second scavenging intake and the other end connected to the first scavenging passage to communicate with the inside of the cylinder via the scavenging port;

an air passage that supplies air for pre-scavenging into the first scavenging passage at a position closer to the first scavenging intake than a position at which the second scavenging passage branches from the first scavenging passage;

a first check valve that inhibits a flow of air from the first scavenging passage to the inside of the crankcase during an upward stroke of the piston; and a second check valve that inhibits a flow of air and the gaseous mixture from the first scavenging passage toward the air passage during a downward stroke of the piston, wherein the engine is configured so that during the upward stroke of the piston, the gaseous mixture is supplied from the intake passage to the inside of the crankcase, and the air, that has been supplied from the air passage, flows into the first and the second scavenging passages, and wherein the engine is configured so that during the downward stroke of the piston, the air, that has entered into the first and the second scavenging passages during the upward stroke of the piston, flows through the scavenging port to the inside of the cylinder, so that the gaseous mixture inside of the crankcase is supplied through the first and the second scavenging passages and the scavenging port to the inside of the cylinder.

2. The stratified scavenging two-stroke engine according to claim 1, wherein the scavenging port is formed such that, when the piston is at a top dead center, a lower edge thereof is located above a bottom face of the piston so that a non-open state of the scavenging port to the inside of the crankcase is maintained.

3. The stratified scavenging two-stroke engine according to claim 1, wherein when the piston is at the top dead center or in its vicinity, the scavenging port is open to the inside of the crankcase.

4. The stratified scavenging two-stroke engine according to claim 1, wherein a part of the second scavenging passage is formed so as to extend to the crankcase wall or to an outside of the crankcase wall.

* * * * *